US010232421B2

(12) United States Patent
Nakaura et al.

(10) Patent No.: US 10,232,421 B2
(45) Date of Patent: Mar. 19, 2019

(54) METHOD OF PRODUCING INNER SPIRAL GROOVED TUBE AND APPARATUS FOR PRODUCING INNER SPIRAL GROOVED TUBE

(71) Applicant: Mitsubishi Aluminum Co., Ltd., Minato-ku (JP)

(72) Inventors: Yusuke Nakaura, Mishima (JP); Yuki Hateruma, Numazu (JP)

(73) Assignee: Mitsubishi Alumnium Co., Ltd., Minato-ku (JP)

( * ) Notice: Subject to any disclaimer, the term of this patent is extended or adjusted under 35 U.S.C. 154(b) by 0 days.

(21) Appl. No.: 15/575,957

(22) PCT Filed: May 6, 2016

(86) PCT No.: PCT/JP2016/063650

§ 371 (c)(1),
(2) Date: Nov. 21, 2017

(87) PCT Pub. No.: WO2016/190068

PCT Pub. Date: Dec. 1, 2016

(65) Prior Publication Data

US 2018/0154412 A1 Jun. 7, 2018

(30) Foreign Application Priority Data

May 28, 2015 (JP) ..... 2015-108307

(51) Int. Cl.
*B21C 1/22* (2006.01)
*B21D 53/06* (2006.01)
(Continued)

(52) U.S. Cl.
CPC ..... *B21C 1/22* (2013.01); *B21C 1/04* (2013.01); *B21C 37/207* (2013.01); *B21D 53/06* (2013.01);
(Continued)

(58) Field of Classification Search
CPC .. B21C 1/22; B21C 1/16; B21C 37/20; B21C 37/22; B21C 37/225; B21C 1/02; B21C 1/20; B21C 3/02
See application file for complete search history.

(56) References Cited

U.S. PATENT DOCUMENTS 2,250,610 A * 7/1941 Simons ..... B21C 1/04 29/33 F
4,735,071 A 4/1988 Ueda et al.
(Continued)

FOREIGN PATENT DOCUMENTS

CN 101793475 A 8/2010
CN 102873121 A 1/2013
(Continued)

OTHER PUBLICATIONS

Internationai Search Report dated Jul. 26, 2016 in PCT/JP2016/063650 Filed May 6, 2016.
(Continued)

*Primary Examiner* — Pradeep C Battula
(74) *Attorney, Agent, or Firm* — Oblon, McClelland, Maier & Neustadt, L.L.P.

(57) ABSTRACT

A method produces an inner spiral grooved tube using a first drawing die, a second drawing die, and a revolving flyer. The method includes two twisting-drawing steps. The first twisting-drawing step forms an intermediate twisted tube by reducing the diameter of a linear grooved tube, which has plural straight grooves formed along the longitudinal direction on its inner surface, by passing the linear grooved tube through the first drawing die and then by revolving the liner grooved tube wrapped around the revolving flyer with the revolving flyer, in conjunction with imparting twist to the linear grooved tube. The second twisting-drawing step forms the inner spiral grooved tube by reducing the diameter of the intermediate twisted tube by passing the intermediate twisted tube, which revolves with the revolving flyer, through the second drawing die in conjunction with imparting twist to the intermediate twisted tube.

7 Claims, 5 Drawing Sheets

(51) Int. Cl.

| | |
|---|---|
| ***B21C 37/20*** | (2006.01) |
| ***B21C 1/04*** | (2006.01) |
| ***F28F 1/40*** | (2006.01) |
| ***F28F 21/08*** | (2006.01) |
| ***F28D 1/047*** | (2006.01) |

(52) U.S. Cl.
CPC ..... *F28D 1/0477* (2013.01); *F28F 1/40* (2013.01); *F28F 21/084* (2013.01)

(56) References Cited

U.S. PATENT DOCUMENTS

| | | | | |
|---|---|---|---|---|
| 4,766,751 | A * | 8/1988 | Ueda | B21C 37/207 72/181 |
| 9,833,825 | B2 * | 12/2017 | Nakaura | B21C 37/20 |

FOREIGN PATENT DOCUMENTS

| | | | |
|---|---|---|---|
| CN | 103433323 | A | 12/2013 |
| JP | 62-240108 | | 10/1987 |
| JP | 62-240109 | | 10/1987 |
| JP | 2012-76126 | | 4/2012 |
| JP | 2012-236225 | | 12/2012 |
| JP | 2014-142173 | | 8/2014 |
| WO | 2014/104371 | A1 | 7/2014 |

OTHER PUBLICATIONS

Written Opinion dated Jul. 26, 2016 in PCT/JP2016/063650 Filed May 6, 2016 (with English Translation).
Office Action dated Sep. 10, 2018 in CN Application No. 201680030197.0 w/partial translation (Search Report only). 9 pp.
OA/Supplemental European Search Report in EP Application No. 16799776.6 dated Oct. 30, 2018.

* cited by examiner

II

METHOD OF PRODUCING INNER SPIRAL GROOVED TUBE AND APPARATUS FOR PRODUCING INNER SPIRAL GROOVED TUBE

TECHNICAL FIELD

The present invention relates to a method of producing an inner spiral grooved tube used for a heat transfer tube of a heat exchanger and an apparatus for producing the inner spiral grooved tube.

Priority is claimed on Japanese Patent Application No. 2015-108307, filed May 28, 2015, the content of which is incorporated herein by reference.

BACKGROUND ART

In a fin-and-tube type heat exchanger such as an air conditioner or a water heater, a heat transfer tube for passing a coolant through the aluminum fin material is provided. In the heat transfer tube, an inner spiral grooved tube having a continuous spiral groove on the inner surface is mainly used for enhancing the heat exchange efficiency with the refrigerant.

Conventionally, copper alloys have been mainly used for heat transfer tubes. However, due to demands for weight saving, cost reduction and improvement in recyclability, there is an increasing demand for the development of heat transfer tubes made of aluminum alloy.

As a method of producing an inner spiral grooved tube (heat transfer tube) made of a copper alloy, a groove rolling method of rolling a spiral groove on the inner surface of at tube is known. However, in a heat transfer tube made of an aluminum alloy, it is necessary to increase the bottom wall thickness in order to increase the pressure resistance, and it was difficult to manufacture by a groove rolling method. Also, in groove rolling, aluminum chip is generated due to friction between the groove plug and the inner surface of the tube, and there is also a problem that it is difficult to remove the chip. Therefore, in order to manufacture an inner spiral grooved tube made of an aluminum alloy, a new production method has been required in place of the groove rolling method.

Patent Literature 1 (PTL 1) discloses an apparatus for producing an inner spiral grooved tube made of an aluminum alloy. In the apparatus, one of one of a winding drum and a rewinding drum is supported by a cradle; and twist is imparted to a tubular material conveyed between the drums by a flyer rotating around the one of the drum

CITATION LIST

Patent Literature

PTL 1: Japanese Unexamined Patent Application, First Publication No. S62-240108 (A)

SUMMARY OF INVENTION

Technical Problem

In the apparatus of producing an inner spiral grooved tube described in PTL 1, since only the torsional stress is imparted to the tubular material as the flyer rotates, buckling is liable to occur in the tubular material. For this reason, in the apparatus of producing an inner spiral grooved tube described in PTL 1, there is a problem that only a small twist of 10° or less can be imparted.

The present invention has been made under the circumstances described above. An object of the present invention to provide a method of producing an inner spiral grooved tube capable of giving a large twist angle and mass production, and an apparatus for producing an inner spiral grooved tube.

Solution to Problem

An aspect of the present invention is a method of producing an inner spiral grooved tube (hereinafter, referred as "the method of producing an inner spiral grooved tube of the present invention") using a first drawing die, a drawing direction of which is a first direction, a second drawing die, a drawing direction of which is a second direction opposite to the first direction, and a revolving flyer, which is configured to invert a tube route of a tubular material from the first direction to the second direction between the first drawing die and the second drawing die and to including:

a first twisting-drawing step to form an intermediate twisted tube by reducing a diameter of a linear grooved tube, on an inner surface of which a plurality of straight grooves is formed along with a longitudinal direction, in conjunction with imparting twist to the linear grooved tube by passing the linear grooved tube through the first drawing die and then by revolving the linear grooved tube by wrapping the linear grooved tube around the revolving flyer; and a second twisting-drawing step to form an inner spiral grooved tube by reducing a diameter of the intermediate twisted tube by passing the intermediate twisted tube, which revolves with the revolving flyer, through the second drawing die in conjunction with imparting twist to the intermediate twisted tube.

In the above-described method of producing an inner spiral grooved tube, each of diameter reduction ratios of tubular material in the first twisting-drawing step and the second twisting-drawing step may be 2% or more and 40% or less.

In addition, a revolving capstan, which revolves in synchronization with the revolving flyer, may be provided on each of a front stage and a rear stage of the revolving flyer for the tubular material to be wound around the revolving capstan.

In addition, a guide capstan may be provided on each of a front stage of the first drawing die and a rear stage of the second drawing die for the tubular material to be wound around the guide capstan.

In addition, a rotary driven capstan in a winding-around direction may be provided on each of rear stages of the first drawing die and the second drawing die to impart forward tension to the tubular material.

In addition, the method may further include a step of unwinding the linear grooved tube from an unwinding bobbin as a pre-process to the first twisting-drawing step to impart backward tension to the linear grooved tube with a brake configured to restrict rotation in an unwinding direction of the unwinding bobbin.

In addition, heat treatment may be performed on the inner spiral grooved tube formed through the second twisting-drawing step, and the first and second twisting-drawing steps may be performed again on the heat treated inner spiral grooved tube to impart an even larger twist angle to the inner spiral grooved tube.

Other aspect of the present invention is an apparatus for producing an inner spiral grooved tube (hereinafter, referred as "the apparatus for producing an inner spiral grooved tube of the present invention") including:

first and second bobbins, one of which is an unwinding bobbin and other of which is a winding bobbin, a tubular material being sent from the one to the other;

a floating frame that supports a shaft of the first bobbin;

a rotary shaft that support the floating frame though bearings and rotates in a direction perpendicular to an axis of the bobbin in the floating frame;

a revolving flyer configured to invert the tube route of a tubular material between the first bobbin and the second bobbin and to revolve around the floating frame as being supported by the rotary shaft; and first and second drawing dice positioned on a front stage and a rear stage of the revolving flyer, respectively, in a tube route of the tubular material, wherein the tubular material unwound from the unwinding bobbin is a linear grooved tube, on an inner surface of which a plurality of straight grooves is formed along with a longitudinal direction, and an inner spiral grooved tube is formed by reducing a diameter of the tubular material by the first and second drawing dice in conjunction with imparting twist associated with the rotation of the revolving flyer to the tubular material.

In the above-described apparatus for producing an inner spiral grooved tube, each of diameter reduction ratios of tubular material in the first and second dice may be 2% or more and 40% or less.

In addition, the apparatus may further include a revolving capstan that is supported by the rotary shaft and configured to revolve in synchronization with the revolving flyer provided on each of a front stage and a rear stage of the revolving flyer.

In addition, the apparatus may further include:

a first guide capstan, which is provided on a front stage of the first drawing die, supported by the floating frame, and is configured for the tubular material to be wrapped around; and a second guide capstan, which is provided on a rear stage of the second drawing die, and is configured for the tubular material to be wrapped around.

In addition, the apparatus may further include a rotary driven capstan in a winding-around direction provided on each of a front stage of the first drawing die and a rear stage of second drawing die for the capstan to impart forward tension to the tubular material.

In addition, the apparatus may further include a brake configured to restrict rotation in an unwinding direction of the unwinding bobbin to impart backward tension to the linear grooved tube.

Advantageous Effects of Invention

According to the production method of the present invention, an inner spiral grooved tube is produced by combined processing in which twisting is applied and at the same time diameter reduction is performed by a drawing die. For this reason, shearing stress due to twisting and withdrawing stress due to drawing are concurrently applied to the tubular material; and twist can be imparted with a less shear stress compared to a case of a simple twisting processing. Accordingly, it is possible to impart a large twist to the tubular material before reaching the buckling stress of the tubular material.

Further, in the production method of the present invention, the tubular material is revolved by the revolving capstan between the first drawing die and the second drawing die which are different from each other in the drawing direction. Thereby, twisting can be applied twice in succession by making the twisting directions coincide with each other between the first twisting-drawing step in the first drawing die and the second twisting-drawing step in the second drawing die. Further, since there is no need to rotate the starting end and the terminal end of the tube route of the tubular material, it is not necessary to revolve the bobbins in the case where the unwinding bobbin, which supplies the tubular material on the starting end of the tube bath, and the winding bobbins, which recover the tubular material on the terminal end of the tube route, are provided. Therefore, it is easy to increase the rotation speed, and the line speed can be increased. In other words, according to the production method of the present invention, it is possible to mass-produce an inner spiral grooved tube to which a large twist angle is imparted.

DESCRIPTION OF EMBODIMENTS

Figure 1:
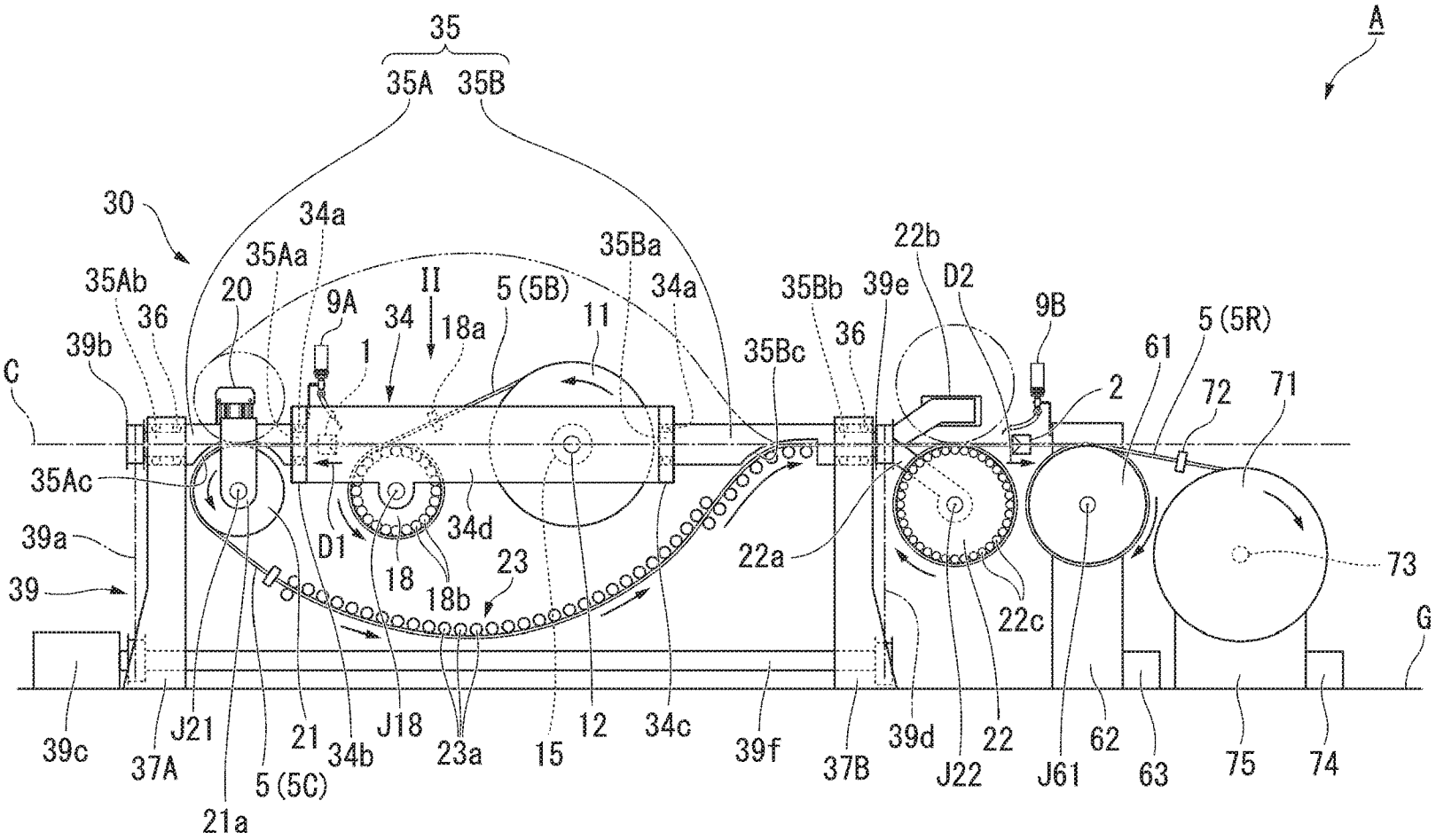
FIG. 1 is a schematic view showing an embodiment of an apparatus for producing an inner spiral grooved tube.

Hereinafter, embodiments of an apparatus for producing an inner spiral grooved tube according to the present invention and a method of producing an inner spiral grooved tube using the apparatus will be described with reference to the drawings. In the drawings used in the following description, for the sake of emphasizing the characteristic portion, there are cases where characteristic portions are enlarged for convenience and there are cases where the dimensional ratio of each component is not the same as the actual one. Also, for the same purpose, some parts that are not characteristic may be omitted for illustration.

In the present specification, the tubular material before being twisted is referred to as "linear grooved tube." Also, the tubular material after being twisted is referred to as "inner spiral grooved tube." Further, in the process from the linear grooved tube to the inner spiral grooved tube, an intermediate product having twisted about half as compared with the inner spiral grooved tube is called "intermediate twisted tube." Furthermore, the term "tubular material" in this specification is a superordinate concept of a linear grooved tube, an intermediate twisted tube and an inner spiral grooved tube, meaning a tube to be processed regardless of the stage of the producing process.

In the present specification, "front stage" and "rear stage" mean a front-to-back relationship (that is, upstream and downstream) along the processing order of the tubular material, and do not mean arrangement of respective portions in the device.

The tubular material is conveyed from the front (upstream) side to the rear (downstream) side in the production apparatus of the inner spiral grooved tube. The parts arranged in the preceding stage are not necessarily arranged in front, and the parts arranged in the rear stages are not necessarily arranged rearward.

<Production Apparatus>

FIG. 1 is a front view showing a production apparatus A for an inner spiral grooved tube.

Figure 3A:
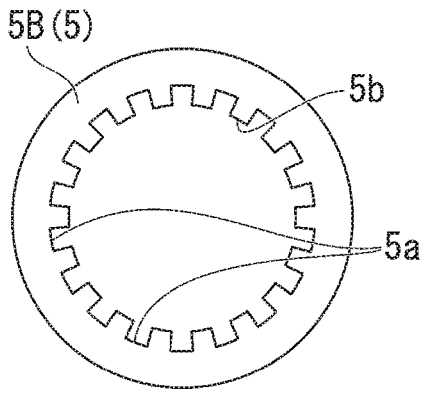
FIG. 3A is a front view of a linear grooved tube having linear grooves formed on its inner surface.
Figure 3B:
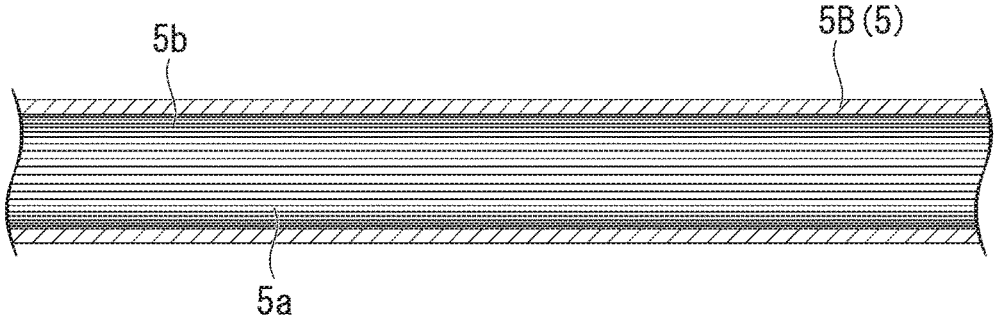
FIG. 3B is a longitudinal sectional view of a linear grooved tube having linear grooves formed on an inner surface thereof.
Figure 4:
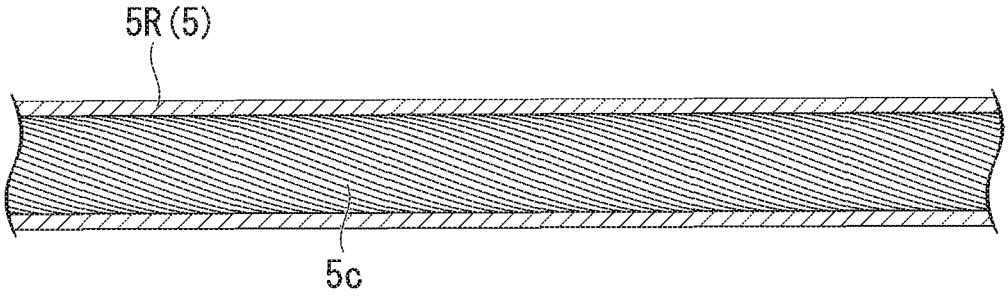
FIG. 4 is a longitudinal sectional view showing an inner spiral grooved tube having a spiral groove formed on an inner surface thereof.

The apparatus A for producing an inner spiral grooved tube according to the present embodiment is an apparatus for producing the inner spiral grooved tubular material 5R shown in FIG. 4 by twisting twice the linear grooved tubular material 5B shown in FIGS. 3A and 3B. As shown in FIGS. 3A and 3B, a plurality of linear grooves 5*a* along the longitudinal direction are formed on the inner surface of the linear grooved tubular material 5B. As shown in FIG. 4, a spiral groove 5*c* originating from the linear groove 5*a* is formed in the inner spiral grooved tubular material 5R which is twisted with the linear grooved tubular material 5B.

The linear grooved tubular material 5B is made of aluminum or an aluminum alloy. The linear grooved tubular material 5B is an extruded material manufactured by extrusion molding and is wound in a coil form on an unwinding bobbin 11 to be described later.

The production apparatus A includes a revolution mechanism 30, a floating frame 34, an unwinding bobbin (first bobbin) 11, a first guide capstan 18, a first drawing die 1, a first revolving capstan 21, a revolving flyer 23, a second revolving capstan 22, a second drawing die 2, a second guide capstan 61, and a winding bobbin (second bobbin) 71.

Details of each part will be described in detail below.

<Revolution Mechanism>

The revolving mechanism 30 has a rotary shaft 35 including a front shaft 35A and a rear shaft 35B, a driving unit 39, a front stand 37A, and a rear stand 37B.

The revolving mechanism 30 rotates the rotary shaft 35 and the first revolving capstan 21, the second revolving capstan 22 and the revolution flyer 23 fixed to the rotary shaft 35.

In addition, the revolving mechanism 30 maintains the stationary state of the floating frame 34 positioned coaxially with the rotation shaft 35 and supported by the rotation shaft 35. Thereby, the stationary state of the unwinding bobbin 11, the first guide capstan 18 and the first drawing die 1 supported by the floating frame 34 is maintained.

Both of the front shaft 35A and the rear shaft 35B have hollow cylindrical shapes. Both of the front shaft 35A and the rear shaft 35B are arranged coaxially with the center axis of the revolution center axis C (the path line of the first drawing dice) as the central axis. The front shaft 35A is rotatably supported on the front stand 37A via a bearing 36 and extends rearward (toward the rear stand 37B) from the front stand 37A. Similarly, the rear shaft 35B is rotatably supported on the rear stand 37B via bearings and extends forward (toward the front stand 37A) from the rear stand 37B. A floating frame 34 is stretched between the front shaft 35A and the rear shaft 35B.

The drive unit 39 has a drive motor 39*c*, a translation shaft 39*f*, belts 39*a* and 39*d*, and pulleys 39*b* and 39*e*. The drive unit 39 rotates the front shaft 35A and the rear shaft 35B.

The drive motor 39*c* rotates the direct drive shaft 39*f* The direct drive shaft 39*f* extends in the front-rear direction at the lower portions of the front stand 37A and the rear stand 37B.

A front end portion 35Ab of the front shaft 35A is attached with a pulley 39*b* at a tip end penetrating the front stand 37A. The pulley 39*b* is interlocked with the translation shaft 39*f* via the belt 39*a*. Likewise, a rear end portion 35Bb of the rear shaft 35B has a pulley 39*e* attached to a tip end penetrating the rear stand 37B, and is interlocked with the translation shaft 39*f* via the belt 39*d*. As a result, the front shaft 35A and the rear shaft 35B synchronously rotate about the revolving rotation center axis C.

The first revolving capstan 21, the second revolving capstan 22, and the revolution flyer 23 are fixed to the rotary shaft 35 (the front shaft 35A and the rear shaft 35B). As the rotary shaft 35 rotates, these members fixed to the rotary shaft 35 revolve around the revolving rotation center axis C as a center.

<Floating Frame>

The floating frame 34 is supported via bearings 34*a* to the mutually facing end portions 35Aa, 35Ba of the front shaft 35A and the rear shaft 35B of the rotary shaft 35. The floating frame 34 supports the unwinding bobbin 11, the first guide capstan 18 and the first drawing die 1.

Figure 2:
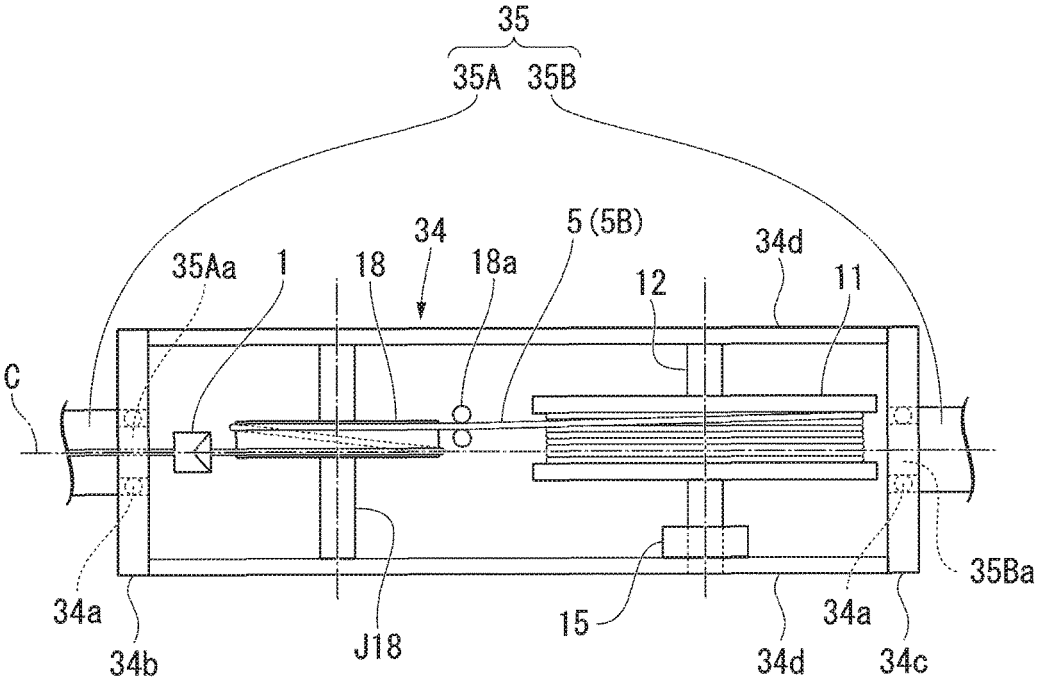
FIG. 2 is a plan view of a floating frame viewed from the direction of an arrow II in FIG. 1.

FIG. 2 is a plan view of the floating frame 34 as seen from the direction of the arrow II in FIG. 1. As shown in FIGS. 1 and 2, the floating frame 34 has a box shape opening vertically. The floating frame 34 has a front wall 34*b* and a rear wall 34*c* opposed to each other in the front-to-rear direction and a pair of support walls 34*d* opposed to the left and right and extending in the front-rear direction.

Through holes are provided in the front wall 34*b* and the rear wall 34*c*, and end portions 35Aa, 35Ba of the front shaft 35A and the rear shaft 35B are inserted, respectively. A bearing 34*a* is interposed between the end portions 35Aa and 35Ba and the through holes of the front wall 34*b* and the rear wall 34*c*. As a result, the rotation of the rotary shaft 35 (the front shaft 35A and the rear shaft 35B) is hardly transmitted to the floating frame 34. The floating frame 34 maintains a stationary state with respect to the ground G even when the rotary shaft 35 is in a rotating state. A weight that biases the center of gravity of the floating frame 34 relative to the revolving rotation center axis C may be provided to stabilize the stationary state of the floating frame 34.

As shown in FIG. 2, the pair of support walls 34*d* are arranged on both sides of the unwinding bobbin 11, the first guide capstan 18 and the first drawing die 1 in the left-right direction (up and down direction in the page of FIG. 2). The pair of support walls 34*d* rotatably supports the bobbin support shaft 12 that holds the unwinding bobbin 11 and the rotation axis J18 of the first guide capstan 18. Further, the support wall 34*d* supports the first drawing die 1 via a die support (not shown).

<Unwinding Bobbin>

In the unwinding bobbin 11, a linear grooved tubular material 5B (see FIGS. 3A and 3B) formed with a linear groove 5*a* is wound. The unwinding bobbin 11 unwinds the linear grooved tubular material 5B and supplies it to the rear stage.

The unwinding bobbin 11 is detachably attached to the bobbin support shaft 12.

As shown in FIG. 2, the bobbin support shaft 12 extends in a direction perpendicular to the rotation shaft 35. Further, the bobbin support shaft 12 is supported by the floating frame 34 so as to be rotatable on its own axis. Here, the rotation on its own axis means to rotate about the central axis of the bobbin support shaft 12 itself The bobbin support shaft 12 holds the unwinding bobbin 11 and rotates on its own axis in the supply direction of the unwinding bobbin 11, thereby assisting the unwinding bobbin 11 to unwind the tubular material 5.

The unwinding bobbin 11 is detached when all the linear grooved tubular material 5B wound is supplied, and is exchanged for another unwinding bobbin. The unwound empty unwinding bobbin 11 is attached to the extruding device forming the linear grooved tubular material 5B, and the linear grooved tubular material 5B is again wound. The unwinding bobbin 11 is supported by the floating frame 34 and does not revolve. Therefore, even if the linear grooved tubular material 5B is irregularly wound on the unwinding bobbin 11, it can be supplied without any problem and can be used without rewinding. In addition, the rotation speed of revolving for imparting twist to the tubular material 5 in the production apparatus A is not limited by the weight of the unwinding bobbin 11. Therefore, the long tubular material 5 can be wound around the unwinding bobbin 11. As a result, twisting can be imparted to the long tubular material 5, and producing efficiency can be enhanced.

On the bobbin support shaft 12, a brake 15 is provided. The brake 15 applies a braking force to the rotation of the bobbin support shaft 12 relative to the floating frame 34. That is, the brake 15 regulates the rotation of the unwinding bobbin 11 in the unwinding direction. By the braking force of the brake 15, the rearward tension is applied to the tubular material 5 conveyed in the unwinding direction. As the brake 15, for example, a powder brake or a band brake capable of adjusting the torque as a braking force can be used.

<First Guide Capstan>

The first guide capstan 18 has a disk shape. In the first guide capstan 18, the tubular material 5 fed out from the unwinding bobbin 11 is wound around one turn. The tangential direction of the outer periphery of the first guide capstan 18 coincides with the revolution rotation central axis C. The first guide capstan 18 guides the tubular material 5 on the revolution rotation central axis C along the first direction D1.

The first guide capstan 18 is supported by the floating frame 34 so as to freely rotate on its axis. On the outer periphery of the first guide capstan 18, guide rollers 18*b* which can freely rotate on its axis are arranged side by side. The first guide capstan 18 of the present embodiment rotates on its own axis and the guide roller 18*b* rolls, but if either one rotates, the tubular material 5 can be conveyed smoothly. In FIG. 2, the illustration of the guide roller 18*b* is omitted.

As shown in FIG. 2, a tube guide portion 18*a* is provided between the first guide capstan 18 and the unwinding bobbin 11. The tube guide portion 18*a* is, for example, a plurality of guide rollers arranged so as to surround the tubular material 5. The tube route guiding portion 18*a* guides the tubular material 5 supplied from the unwinding bobbin 11 to the first guide capstan 18.

Instead of the first guide capstan 18, a guide tube having a traverse function may be provided between the unwinding bobbin 11 and the first drawing die 1. In the case of providing the guide tube, it is possible to shorten the distance between the unwinding bobbin 11 and the first drawing die 1, and it is possible to effectively utilize the space inside the factory.

<First Drawing Die>

The first drawing die 1 reduces the diameter of the tubular material 5 (linear grooved tubular material 5B). The first drawing die 1 is fixed to the floating frame 34. In the first drawing die 1, the first direction D1 is taken as the drawing direction. The center of the first drawing die 1 coincides with the revolving rotation center axis C of the rotary shaft 35. In addition, the first direction D1 is parallel to the revolution rotation central axis C.

Lubricant is supplied to the first drawing die 1 by the lubricant supply device 9A fixed to the floating frame 34. As a result, the pulling force in the first drawing die 1 can be reduced.

The tubular material 5 having passed through the first drawing die 1 is introduced into the front shaft 35A through a through hole provided in the front wall 34*b* of the floating frame 34.

<First Revolving Capstan>

The first revolving capstan 21 has a disk shape. The first revolving capstan 21 is disposed in a transverse hole 35Ac that passes through the hollow front shaft 35A in the radial direction. The first revolving capstan 21 is supported on the support 21*a* fixed to the outer periphery of the rotary shaft 35 (front shaft 35A) with the center of the disk as the rotation axis J21 in a freely rotatable state.

In the first revolving capstan 21, one of the tangent lines of the outer circumference substantially coincides with the revolution rotation central axis C. The first revolving capstan 21 is wound around the tubular material 5 which is conveyed in the first direction D1 on the revolution rotation central axis C for one or more rounds. The first revolving capstan 21 is wound around the tubular material 5 and is drawn out from the inside of the front shaft 35A to the outside and guided to the revolution flyer 23.

The first revolving capstan 21 revolves together with the front shaft 35A around the revolution rotation central axis C. The revolving rotation center axis C extends in a direction perpendicular to the rotation axis J21 of rotation of the first revolving capstan 21. Torsion is imparted to the tubular material 5 between the first revolving capstan 21 and the first withdrawing die 1. As a result, the tubular material 5 becomes the intermediate twisted tubular material 5 C from the linear grooved tubular material 5B.

A drive motor 20 is provided on the front shaft 35A together with the first revolving capstan 21. The drive motor 20 drives and rotates the first revolving capstan 21 in a direction in which the tubular material 5 is wrapped (in the conveying direction). As a result, the first revolving capstan 21 imparts forward tension to the tubular material 5 to pass through the first drawing die 1.

It is preferable that the first revolving capstan 21 and the drive motor 20 are disposed symmetrically with respect to the revolution rotation central axis C so that the center of gravity is located on the revolution rotation central axis C of the front shaft 35A. This makes it possible to stabilize the balance of the rotation of the front shaft 35A. If the weight difference between the first revolving capstan 21 and the drive motor 20 is large, a weight may be provided to stabilize the center of gravity.

<Turning Flyer>

The revolving flyer 23 inverts the tube route of the tubular material 5 between the first drawing die 1 and the second drawing die 2. The revolving flyer 23 inverts the tubular material 5 conveyed in the first direction D1 which is the drawing direction of the first drawing die 1; and directs the conveying direction in a second direction D2, which is a drawing direction of the second drawing die 2. More specifically, the revolving flyer 23 guides the tubular material 5 from the first revolving capstan 21 to the second revolving capstan 22.

The revolving flyer 23 has a plurality of guide rollers 23*a* and a guide roller support body (not shown) for supporting the guide rollers 23*a*. Although the illustration of the guide roller support body is omitted here for the purpose of solving the complication, the guide roller support body is supported by the rotation shaft 35. However, with respect to the structure of the flyer, the guide roller is not indispensable, and it may be a plate-shaped structure for simply passing the tube, and a shape with a ring attached for passing it. This ring may be provided on a plate-shaped member. A part of this ring may be constituted by a part of this plate shaped member. The plate shaped member may be supported by the rotary shaft 35 in the same manner as the guide roller supporting body.

The guide rollers 23*a* are arranged side by side in a bow shape bending outward with respect to the revolution rotation central axis C. The guide roller 23*a* itself rolls and smoothly conveys the tubular material 5. The revolving flyer 23 rotates about the revolving rotation center axis C around the floating frame 34 and the first drawing die 1 and the unwinding bobbin 11 supported in the floating frame 34.

One end of the revolving flyer 23 is positioned outside the first revolving capstan 21 with respect to the revolution rotation central axis C. The other end of the revolving flyer 23 passes through a transverse hole 35Bc penetrating the inside and the outside of the hollow rear shaft 35B in the radial direction and extends to the inside of the rear shaft 35B. The revolving flyer 23 guides the tubular material 5 wound around the first revolving capstan 21 and drawn out to the rear shaft 35B side. In addition, the revolving flyer 23 feeds the tubular material 5 on the revolution rotation center axis C along the second direction D2 inside the rear shaft 35B.

It is to be noted that the revolving flyer 23 of the present embodiment has been described as a conveyer of the tubular material 5 by the guide roller 23*a*. However, the revolving flyer 23 may be formed from a band plate formed in an arcuate shape, and the tubular material 5 may be conveyed while sliding over one side of the band plate.

Also, in FIG. 1, the case where the tubular material 5 passes outside the guide roller 23*a* has been exemplified.

However, when the rotation speed of the revolving flyer 23 is high, the tubular material 5 may be derailed from the revolution flyer by centrifugal force. In such a case, it is preferable to further provide the guide roller 23*a* on the outside of the tubular material 5.

A plurality of dummy fliers having the same weight as the revolving flyer 23 and extending from the front shaft 35A to the rear shaft 35B and rotating synchronously with the revolving flyer 23 may be provided. This makes it possible to stabilize the rotation of the rotary shaft 35.

<Second Revolving Capstan>

Like the first revolving capstan 21, the second revolving capstan 22 has a disk shape. The second revolving capstan 22 is supported in a freely rotatable state on a support 22 a provided at the end of the end portion 35Bb of the rear shaft 35B. On the outer periphery of the second revolving capstan 22, guide rollers 22*c* freely rotatable are arranged side by side. The second revolving capstan 22 of the present embodiment rotates itself and the guide roller 22*c* rolls, but if either one rotates, the tubular material 5 can be smoothly conveyed.

In the second revolving capstan 22, one of the tangent lines of the outer circumference substantially coincides with the revolution rotation central axis C. The second revolving capstan 22 is wound around the tubular material 5 that is conveyed in the second direction D 2 on the revolution rotation central axis C for one or more rounds. The second revolving capstan 22 feeds the wound tubular material in the second direction D2 on the revolution center axis C.

The second revolving capstan 22 revolves around the revolution rotation center axis C together with the rear shaft 35B. The revolution center axis C extends in a direction perpendicular to the rotation axis J22 of rotation of the second revolving capstan 22. The tubular material 5 withdrawn from the second revolving capstan 22 is contracted in diameter at the second drawing die 2. Since the second drawing die 2 is stationary with respect to the ground G, twisting can be imparted to the tubular material 5 between the second revolving capstan 22 and the second drawing die 2. As a result, the tubular material 5 becomes the inner spiral grooved tubular material 5R from the intermediate twisted tubular material 5C.

The support body 22*a* supporting the second revolving capstan 22 supports the weight 22*b* at a position symmetrical to the second revolving capstan 22 with respect to the revolution rotation central axis C. The weight 22*b* stabilizes the balance of the rotation of the rear shaft 35B.

<Second Drawing Die>

The second drawing die 2 is arranged at the rear stage of the second revolving capstan 22. The second drawing die 2 has an opposite second direction D2 as a drawing direction. The second direction D2 is a direction parallel to the revolution rotation central axis C. The second direction D2 is opposite to the first direction D1 which is the drawing direction of the first drawing die 1. The tubing 5 passes through the second drawing die 2 along the second direction D2. In the second drawing die 2, the second drawing die 2 is stationary with respect to the ground G The center of the second drawing die 2 coincides with the revolution center axis C of the rotary shaft 35.

The second drawing die 2 is supported on the cradle 62 via, for example, a die support (not shown). Further, lubricant is supplied to the second drawing die 2 by the lubricant supply device 9B attached to the frame 62. As a result, the pulling force in the second drawing die 2 can be reduced.

Due to the diameter reduction and twist imparting in the second drawing die 2, the tubular material 5 becomes an inner spiral grooved tubular material 5R from the intermediate twisted tubular material 5C.

<Second Guide Capstan>

The second guide capstan 61 has a disk shape. The tangential direction of the outer periphery of the second guide capstan 61 coincides with the revolution rotation central axis C. The second guide capstan 61 is wound around the tubular material 5 that is conveyed in the second direction D2 on the revolution rotation central axis C for one or more rounds.

The second guide capstan 61 is rotatably supported by the cradle 62 around the rotation axis J61. The rotation axis J61 of the second guide capstan 61 is connected to the drive motor 63 via a drive belt or the like. The second guide capstan 61 is driven and rotated in the direction of winding (advancement direction) of the tubular material 5 by the drive motor 63. It is preferable to use a torque motor capable of torque control for the drive motor 63.

As the second guide capstan 61 is driven, a forward tension is applied to the tubular material 5. As a result, the tubular material 5 is drawn with drawing stress necessary for processing in the second drawing die 2 and is conveyed forward.

<Winding Bobbin>

The winding bobbin 71 is provided at the terminal end of the tube route of the tubular material 5 and recovers the tubular material 5. A guide portion 72 is provided in front of the winding bobbin 71. The guiding portion 72 has a traverse function and aligns and winds the tubular material 5 on the winding bobbin 71.

The winding bobbin 71 is detachably attached to the bobbin support shaft 73. The bobbin support shaft 73 is supported by the cradle 75 and is connected to the drive motor 74 via a drive belt or the like. The winding bobbin 71 is driven and rotated by the drive motor 74, and winds up the tubular material 5 without slackening. The winding bobbin 71 is detached when the tubular material 5 is sufficiently wound, and is replaced with another winding bobbin 71.

<Method of Producing Inner Spiral Grooved Tube>

A method of producing the inner spiral grooved tubular material 5R by using the production apparatus A for the inner spiral grooved tube described above will be described.

First, the preparatory process will be described.

As shown in FIGS. 3A and 3B, by extrusion molding, a linear grooved tubular material 5B in which a plurality of linear grooves 5*a* along the longitudinal direction along the inner surface are formed at intervals in the circumferential direction is produced (straight tube grooved tube extrusion process). Further, the linear grooved tubular material 5B is wound around the unwinding bobbin 11 in a coil shape. Further, the unwinding bobbin 11 is set in the floating frame 34 of the production apparatus A. Further, the tubular material 5 (linear grooved tubular material 5B) is unwound from the unwinding bobbin 11, and the tube route of the linear grooved tubular material 5B is set in advance. Specifically, the tubular material 5 is inserted between the first guide capstan 18, the first drawing die 1, the first revolving capstan 21, the revolution flyer 23, the second revolving capstan 22, the second drawing die 2, the second guide capstan 61, and the winding bobbin 71 in this order, and sets them.

After completion of the preliminary step described above, production of the inner spiral grooved tubular material 5R is started.

In the producing process of the inner spiral grooved tubular material 5R, explanation will be given along the conveying path of the tubular material.

First, the tubular material 5 is sequentially unwound from the unwinding bobbin 11. Next, the tubular material 5 fed out from the unwinding bobbin 11 is wound around the first guide capstan 18. The first guide capstan 18 guides the tubular material 5 to the die hole of the first drawing die 1 located on the revolution center axis C (first guiding step).

Next, the tubing 5 is passed through the first drawing die 1. Further, at the rear stage of the first drawing die 1, the tubular material 5 is wound around the first revolving capstan 21 and rotated around the rotation axis.

As a result, the tubular material 5 is reduced in diameter and twisted (first twisting-drawing step).

In the first twisting-drawing step, forward tension is imparted to the tubular material 5 by the drive motor 20 that drives the first revolving capstan 21. At the same time, rearward tension is applied to the tubular material 5 by the brake 15 of the unwinding bobbin 11. Therefore, it is possible to apply an appropriate tension to the tubular material 5, and a stable twisting angle can be imparted to the tubular material 5 without causing buckling or fracture.

After passing through the first drawing die 1, the tubular material 5 is wound around the first revolving capstan 21 revolving. The tubular material 5 is reduced in diameter by the first drawing die 1 and is twisted by the first revolving capstan 21. As a result, a straight groove 5*a* (see FIGS. 3A and 3B) on the inner surface of the tubular material 5 (linear grooved tubular material 5B) is twisted and a spiral groove 5*c* is formed on the inner surface. In the first twisting-drawing step, the linear grooved tubular material 5B becomes the intermediate twisted tubular material 5C. The intermediate twisted tubular material 5C is a tubular material at an intermediate stage in the process of producing the inner spiral grooved tubular material 5R and a state in which a helical groove having a shallow twist angle is formed from the spiral groove 5*c* of the inner spiral grooved tubular material 5R.

In the first twisting-drawing step, twist is imparted to the tubular material 5, and at the same time, diameter reduction is performed by the drawing die. That is, the tubular material 5 is given combined stress by simultaneous processing of twisting and contraction. Under composite stress, the yield stress of the tubular material 5 becomes smaller as compared with the case where only the twisting processing is performed, and a large twist can be applied to the tubular material 5 before reaching the buckling stress of the tubular material 5. This makes it possible to impart a large twist while suppressing occurrence of buckling of the tubular material 5.

A first guide capstan 18 is provided in the front stage of the first drawing die 1, and the rotation of the tubular material 5 is restricted. That is, the deformation of the tubular material 5 in the twisting direction is restricted at the front stage of the first drawing die 1. Torsion is imparted to the tubular material 5 between the first drawing die 1 and the first revolving capstan 21. That is, in the first twisting-drawing step, the region (work area) to which the twist is imparted to the tubular material 5 is limited between the first drawing die 1 and the first revolving capstan 21.

There is a correlation between the length of the processing area and the twist angle limit (maximum twist angle that can be twisted without causing buckling); and even if a large twist angle is given by shortening the processing area, buckling is unlikely to occur. By providing the first guide capstan 18, twisting is not applied at the front stage of the first drawing die 1, and the processing area can be set short. Further, by setting the distance between the first drawing die 1 and the first revolving capstan 21 short, it is possible to shorten the processing area, and to give a large twist to the tubular material 5 without causing buckling.

The diameter reduction ratio of the tubular material 5 by the first drawing die 1 is preferably 2% or more.

Figure 5:
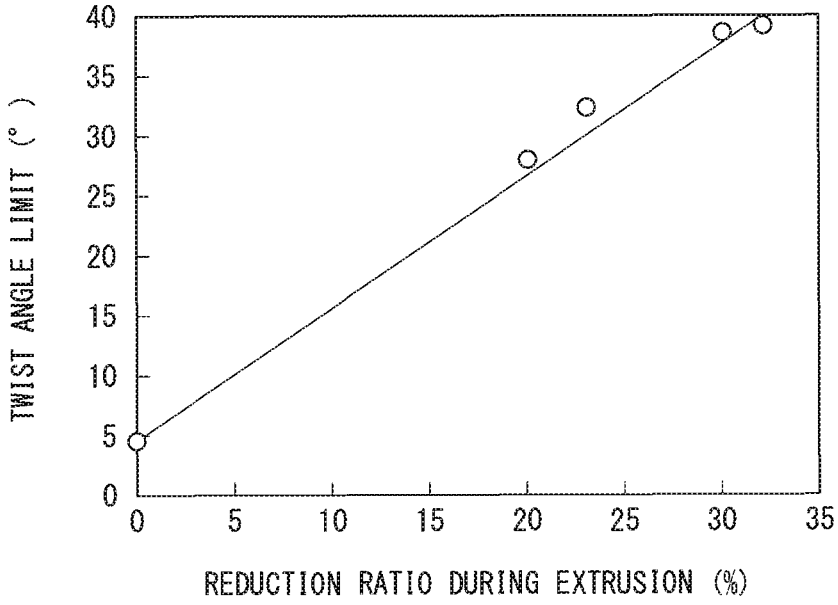
FIG. 5 is a graph showing the relationship between the diameter reduction ratio and the critical twist angle at the time of drawing.

FIG. 5 is a graph showing the results of preliminary experiments investigating the relationship between the twist angle limit and the diameter reduction ratio at the time of drawing. As shown in FIG. 5, there is a correlation between the critical twist angle and the diameter reduction ratio, and there is a tendency that the twist angle limit increases as the diameter reduction ratio at the time of drawing increases. That is, when the diameter reduction ratio is too small, the effect of drawing is poor and it is difficult to obtain a large twist angle, so it is preferable to set it to 2% or more. For the same reason, it is more preferable to reduce the diameter reduction ratio to 5% or more.

On the other hand, if the diameter reduction ratio becomes too large, rupture tends to occur at the processing limit, so it is preferable to set it to 40% or less.

Next, the tubular material 5 is wound around the revolving flyer 23, and the conveying direction of the tubular material 5 is directed in the second direction D2 on the revolution rotational center axis C. Further, the tubular material 5 is wound around the second revolving capstan 22, and the tubular material 5 is introduced into the second drawing die 2 (second guiding step). As a result, the conveying direction of the tubular material 5 is inverted from the first direction D1 to the second direction D2, and is aligned with the center of the second drawing die 2. The revolving flyer 23 rotates around the revolving rotation center axis C around the float frame 34. The first revolving capstan 21, the revolution flyer 23, and the second revolving capstan 22 are synchronously rotated around the revolution rotation center axis C as a center. Therefore, between the first revolving capstan 21 and the second revolving capstan 22, the tubular material 5 does not relatively rotate and is not twisted.

Next, the tubular material 5 rotating together with the second revolving capstan 22 is passed through the second drawing die 2. As a result, the tubular material 5 is reduced in diameter and twisted, and the twisting angle of the spiral groove 5*c* is further increased (second twisting-drawing step). By the second twist-drawing step, the intermediate twisted tubular material 5C becomes the inner spiral grooved tubular material 5R.

In the second twisting-drawing step, a forward tension is applied to the tubular material 5 by a drive motor 63 that drives the second guide capstan 61. In the case where a torque motor capable of torque control is used as the drive motor 63, the second guide capstan 61 can adjust the forward tension applied to the tubular material 5. By adjusting the forward tension by the second guide capstan 61, it is possible to apply a moderate tension to the tubular material 5 in the second twisting-drawing step. As a result, a stable twist angle can be imparted to the tubular material 5 without causing buckling or rupture.

The tubular material 5 passes through the second drawing die 2 after being wound around the second revolving capstan 22 that revolves. The tubular material 5 is contracted in diameter by the second drawing die 2 and twist is imparted to the tubular material 5 by the second revolving capstan 22. As a result, a larger twist is imparted to the spiral groove 5*c* on the inner surface of the tubular material 5, and the twist angle of the spiral groove 5*c* is increased. By the second twist drawing process, the intermediate twisted tubular material 5C becomes the inner spiral grooved tubular material 5R.

In the front stage of the second drawing die 2, the tubular material 5 is wound around the second revolving capstan 22. In the latter stage of the second drawing die 2, the second guide capstan 61 is provided, and the rotation of the tubular material 5 is restricted. That is, the deformation of the tubular material 5 in the twisting direction is restricted before and after the second drawing die 2; and the twisting of the tubular material 5 is imparted between the second revolving capstan 22 and the second guide capstan 61. That is, in the second twisting-drawing step, the region (work area) to which the twist is imparted to the tubular material 5 is restricted between the second revolving capstan 22 and the second withdrawing die 2. As described above, by shortening the processing area, buckling is unlikely to occur even if a large twist angle is imparted. By providing the second guide capstan 61, twisting is not imparted at the rear stage of the second drawing die 2, and the processing area can be set short.

In the present embodiment, the second revolving capstan 22 is provided on the rear side of the rear stand 37B (on the side of the second drawing die 2), but the second revolving capstan 22 is provided on the front stand 37, and may be located between the rear stand 37B. However, by disposing the second revolving capstan 22 in a rearward side with respect to the rear stand 37B and bringing it closer to the second drawing die 2, it is possible to shorten the processing area in the second twisting-drawing step. Thus, the occurrence of buckling can be suppressed more effectively.

In the second twisting-drawing step, similarly to the first twisting-drawing step, twisting and diameter reduction are performed, and combined stress is imparted to the tubular material 5. As a result, before the buckling stress of the tubular material 5 is reached, a large twist can be imparted while suppressing occurrence of buckling in the tubular material.

As in the first twisting-drawing step, the diameter reduction ratio of the tubular material 5 by the second drawing die 2 is preferably 2% or more (more preferably 5% or more) and 40% or less.

In the first drawing die 1, when the diameter reduction is large (for example, diameter reduction with a diameter reduction ratio of 30% or more), the tubular material 5 is work-hardened. Thus, it becomes difficult to perform a large reduction in diameter by the second drawing die 2. Therefore, it is preferable that the total of the diameter reduction ratios of the first drawing die 1 and the second drawing die 2 is 4% or more and 50% or less.

Next, the tubular material 5 is wound around the winding bobbin 71 and recovered. The winding bobbin 71 rotates in synchronism with the conveying speed of the tubular material 5 by the driving motor 74, so that the tubular material 5 can be wound without slack.

Through the above steps, using the production apparatus A, it is possible to produce the inner spiral grooved tubular material 5R shown in FIG. 4.

In the production method of the present embodiment, the first twisting-drawing step and the second twisting-drawing step are performed again on the inner spiral grooved tubular material 5R formed through the above-described process to impart a larger twist angle. In this case, heat treatment (annealing) is performed on the inner spiral grooved tubular material 5R that has undergone the above-described steps to make it into an "O material." Further, the unwinding bobbin 11 is wound around the unwinding bobbin 11 and attached to the production apparatus A having the first drawing dice and the second drawing dice having an appropriate diameter reduction ratio. Further, by using the production apparatus A through the same steps (the first twisting-drawing step and the second twisting-drawing step) as the above-described steps, it is possible to manufacture the inner spiral grooved tube imparted with a larger twist angle.

According to the production method of the present embodiment, as compared with the conventional production method disclosed in PTL 1, since the diameter reduction is performed simultaneously with twisting, the outer diameter and the cross-sectional area of the starting material and the final product are different. Moreover, in order to impart a combined stress of twisting and contraction to the tubular material, it becomes possible to reduce the shear stress required for twisting, and before the buckling stress of the tubular material 5 is reached, a large twist can be imparted to the tubular material 5. In the production apparatus disclosed in PTL 1, it is believed that application of twisting angle of about 10° is the limit because twisting of about 5° with 0% reduction ratio in FIG. 5 is performed twice.

According to the production method of the present embodiment, since twisting is given to the linear grooved tubular material 5B and diameter reduction is performed, a large twist angle can be imparted while suppressing buckling occurrence. In the present embodiment, the outer diameter of the linear grooved tubular material 5B as a material is 1.1 times or more the outer diameter of the inner spiral grooved tubular material 5R as the final product.

According to the production method of the present embodiment, twisting is imparted to the tubular material 5 by the first revolving capstan 21 between the first drawing die 1 and the second drawing die 2. Further, the drawing direction of the first drawing die 1 and the second drawing die 2 is inverted. Thereby, twisting can be imparted to the tubular material 5 by making the twisting directions coincide in the first twist drawing process and the second twist drawing process. Further, it is unnecessary to revolve the unwinding bobbin 11 which is the starting end of the tubular material of the tubular material 5 and the winding bobbin 71 which is the terminal end of the tube route. Since the speed of the line depends on the rotation speed, in the production method according to this embodiment that does not rotate the unwinding bobbin 11 or the winding bobbin 71 which is a heavy object, the rotation speed can be easily increased. That is, according to the present embodiment, the line speed can be easily increased.

Furthermore, in the present embodiment, since the unwinding bobbin 11 is not revolved, it is possible to wind the long linear grooved tubular material 5B (tubular material 5) around the unwinding bobbin 11. Therefore, according to the production method of the present embodiment, twist can be imparted to a long tubular material 5 at a single continuous operation without changing the unwinding bobbin 11. That is, according to the present embodiment, it is easy to mass-produce the inner spiral grooved tubular material 5R.

The production method of the present embodiment is to twist the tubular material 5 through at least two twisting-drawing steps. Therefore, a large twist angle can be imparted by compounding the twist angles applied in the twisting-drawing step of each stage.

According to the production method of the present embodiment, in the first twisting-drawing step and the second twisting-drawing step, forward and backward tensions are imparted to the tubular material 5. The forward tension is applied to the tubular material 5 by the second guide capstan 61 and the rearward tension is applied to the tubular material 5 by the brake 15 that puts brake on the unwinding bobbin 11. With this, an appropriate tension can be stably applied to the tubular material 5 to be processed. Since there is no looseness in the tube route of the tubular material 5 and the linear grooved tubular material 5B enters the drawing die without misalignment, a stable twist angle can be imparted to the tubular material 5 without causing buckling and rupture.

In the present embodiment, the centers of the first drawing dies 1 and the second drawing die 2 die holes are positioned on the revolution rotation central axis C. As a result, since the tubular material 5 passing through the die hole can be linearly arranged with respect to the die hole, the tubular material 5 can be reduced in diameter uniformly and buckling at the time of twisting can be suppressed. In the first drawing die 1 and the second drawing die 2, as long as the tubular material 5 can be reduced in diameter, the displacement of the die hole with respect to the revolution center axis C is permitted.

In the present embodiment, it has been described that the unwinding bobbin 11 is supported by the floating frame 34 and the winding bobbin 71 is installed on the ground G However, whichever of the unwinding bobbin 11 and the winding bobbin 71 may be supported by the floating frame 34. That is, in FIG. 1, the unwinding bobbin 11 and the winding bobbin 71 may be interchanged. In this case, the conveying path of the tubular material 5 is reversed. Further, the first drawing die 1 and the second drawing die 2 are interchanged, and the drawing directions of the drawing dies 1 and 2 are reversed and arranged along the conveying direction. Further, in the capstans positioned before and after the drawing dies 1, 2, the capstan located at the rear stage of the drawing die is driven in the winding direction (conveying direction) of the tubular material, and the forward tension against the drawing force at the drawing die is set to give.

<Heat Exchanger>

Figure 6A:
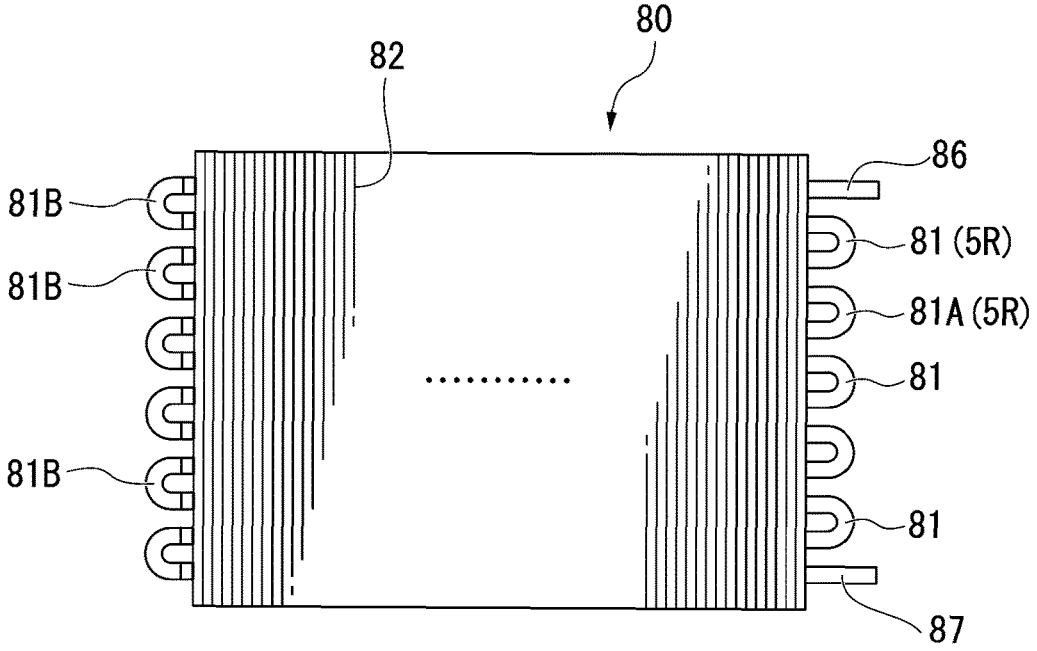
FIG. 6A is an example of a heat exchanger having an inner spiral grooved tube, and is a side view thereof.
Figure 6B:
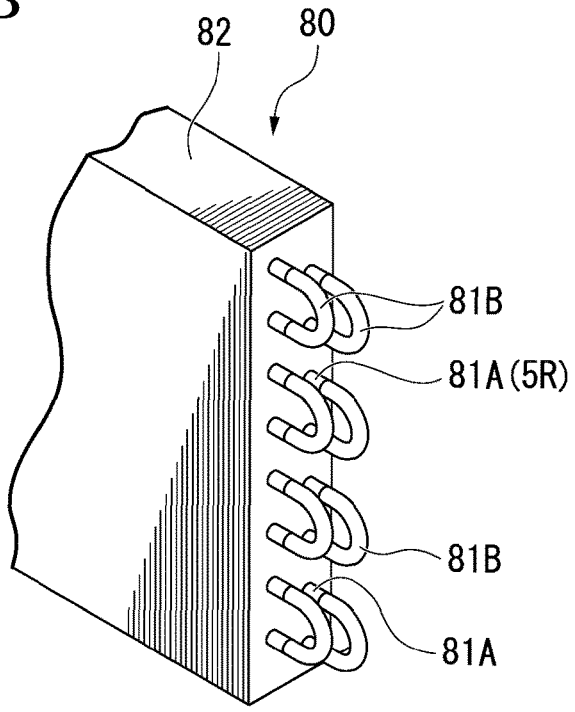
FIG. 6B is a perspective view thereof.

FIGS. 6A and 6B are schematic diagrams showing an example of a heat exchanger 80 having an inner spiral grooved tube according to the present invention. As a tube through which a refrigerant passes, an inner spiral grooved tube 81 (inner spiral grooved tube 5R) are provided in a meandering manner, and a plurality of aluminum alloy fin members 82 are disposed in parallel around the inner spiral grooved tube 81. The inner spiral grooved tube 81 is provided so as to pass through a plurality of through holes provided so as to penetrate the fin members 82 arranged in parallel.

In the structure of the heat exchanger 80 shown in FIGS. 6A and 6B, the inner spiral grooved tube 81 has a plurality of U-shaped main tubes 81A penetrating the fin material 82 in a straight line manner and a plurality of U-shaped main tubes 81A which are adjacent end portions And the openings are connected by a U-shaped elbow tube 81B as shown in FIG. 6B. A refrigerant inlet portion 86 is formed on one end side of the inner surface spiral grooved tube 81 penetrating the fin material 82 and an outlet portion 87 of the refrigerant is formed on the other end portion side of the inner surface spiral grooved tube 81, thereby forming the heat exchanger 80 shown in FIGS. 6A and 6B.

In the heat exchanger 80 shown in FIGS. 6A and 6B, an inner spiral grooved tube 81 is assembled by: providing the inner spiral grooved tube 81 so as to penetrate a through hole formed in each of the fin materials 82; and extending the outer diameter of the inner spiral grooved tube 81 by an expansion plug after inserting it into the through hole of the fin materials 82 for the inner spiral grooved tube 81 and the fin materials 82 to be mechanically integrated.

By using the inner spiral grooved tube 81 to the heat exchanger 80 shown in FIGS. 6A and 6B, a heat exchanger 80 having excellent heat exchange efficiency can be provided.

Further, for example, when the heat exchanger 80 is configured by using the inner spiral grooved tube 5R made of aluminum or an aluminum alloy having an outer diameter of the inner spiral grooved tube 5R as small as 10 mm or less, a small-sized high performance heat exchanger, which has no need for separation between the fin materials 82 and the inner spiral grooved tube 81 in recycling process and with excellent recyclability, can be provided.

Although the various embodiments of the present invention have been described above, the respective configurations and combinations thereof in each embodiment are merely examples, and additions, omissions, substitutions, modifications, etc. of configurations are possible without departing from the scope of the present invention, and other changes are possible. Further, the present invention is not limited by the embodiment.

INDUSTRIAL APPLICABILITY

It is possible to manufacture a heat transfer tube made of an aluminum alloy and having a spiral groove on its inner surface at low cost. As a result, the heat exchanger is reduced in cost, reduced in weight, improved in performance, and the like.

REFERENCE SIGNS LIST

1: First drawing die
2: Second drawing die
5: Tubular material
5B: Linear grooved tube
5C: Intermediate twisted tube
5R, 81: Inner spiral grooved tube
11: Unwinding bobbin (First bobbin)
12, 73: Bobbin support shaft (Axis of the bobbin)
15: Brake
18: First guide capstan
20, 39*c*, 63, 74: Drive motor
21: First revolving capstan
22: Second revolving capstan
23: Revolving flyer
30: Revolution mechanism
34: Floating frame
34*a*, 36: Bearing
35: Rotary shaft
35A: Front shaft
35B: Rear shaft
37A: Front stand
37B: Rear stand
39: Drive unit
61: Second guide capstan
71: Winding bobbin (Second bobbin)
80: Heat exchanger
82: Fin material
A: Production apparatus
C: Revolving rotation central axis
D1: First direction
D2: Second direction
G: Ground
J18, J21, J22, J61: Rotation axis

What is claimed is:

1. A method of producing an inner spiral grooved tube using a first drawing die, a drawing direction of which is a first direction, a second drawing die, a drawing direction of which is a second direction opposite to the first direction, and a revolving flyer, which is configured to invert a tube route of a tubular material from the first direction to the second direction between the first drawing die and the second drawing die and to revolve around any one of the first drawing die and the second drawing die, the method comprising:

(I) forming an intermediate twisted tube by reducing a diameter of a linear grooved tube, on an inner surface of which a plurality of straight grooves is formed along a longitudinal direction, by passing the linear grooved tube through the first drawing die, and then by conveying the linear grooved tube via the revolving flyer and revolving the linear grooved tube with the revolving flyer, in conjunction with imparting twist to the linear grooved tube; and (II) forming an inner spiral grooved tube by reducing a diameter of the intermediate twisted tube by passing the intermediate twisted tube, which revolves with the revolving flyer, through the second drawing die, in conjunction with imparting twist to the intermediate twisted tube.

2. The method according to claim 1, wherein each of diameter reduction ratios of tubular material in in said forming (I) and forming (II) is 2% or more and 40% or less.

3. The method according to claim 1, wherein a revolving capstan, which revolves in synchronization with the revolving flyer, is provided on each of a front stage and a rear stage of the revolving flyer for the tubular material to be wound around the revolving capstan.

4. The method according to claim 1, wherein a guide capstan is provided on each of a front stage of the first drawing die and a rear stage of the second drawing die for the tubular material to be wound around the guide capstan.

5. The method according to claim 1, wherein a rotary driven capstan in a winding-around direction is provided on each of rear stages of the first drawing die and the second drawing die to impart forward tension to the tubular material.

6. The method according to claim 1, further comprising:

unwinding the linear grooved tube from an unwinding bobbin as a pre-process to said forming (I) to impart backward tension to the linear grooved tube with a brake configured to restrict rotation in an unwinding direction of the unwinding bobbin.

7. The method according to claim 1, wherein a heat treatment is performed on the inner spiral grooved tube formed through said forming (II), thereby obtaining a heat treated inner spiral grooved tube, and said forming (I) and forming (II) are performed again on the heat treated inner spiral grooved tube to impart an even larger twist angle to the inner spiral grooved tube.

* * * * *